United States Patent [19]

White et al.

[11] 4,274,389

[45] Jun. 23, 1981

[54] CUTTING APPARATUS FOR SEMI-CONDUCTOR MATERIALS

[75] Inventors: Arnold G. White, Trail; James K. Tarbet, Montrose; Dennis A. Vanness; Gordon J. Woods, both of Trail; William F. H. Micklethwaite, Rossland, all of Canada

[73] Assignee: Cominco Ltd., Vancouver, Canada

[21] Appl. No.: 130,933

[22] Filed: Mar. 17, 1980

[30] Foreign Application Priority Data

Jan. 25, 1980 [CA] Canada ..... 344392

[51] Int. Cl.[3] ..... B28D 1/08; B26D 1/54

[52] U.S. Cl. ..... 125/21; 83/168; 83/820

[58] Field of Search ..... 125/21; 83/820, 168

[56] References Cited

U.S. PATENT DOCUMENTS

| | | | |
|---|---|---|---|
| 1,017,207 | 2/1912 | Eggers | 125/21 |
| 3,374,816 | 3/1968 | Alich | 83/820 |
| 3,452,734 | 7/1969 | Cleland | 125/21 |
| 3,563,285 | 2/1971 | Thrasher | 83/820 |
| 3,599,623 | 8/1971 | Phy | 125/21 |
| 4,085,636 | 4/1978 | Eklund | 83/820 |

*Primary Examiner*—Harold D. Whitehead
*Attorney, Agent, or Firm*—Arne I. Fors

[57] ABSTRACT

A cutting apparatus for slicing semiconductor materials into wafers is disclosed.

The cutting apparatus broadly comprises a pair of spaced-apart co-planar rotatable wheels, a continuous metallic band passing over said wheels, means for driving one of said wheels to move said band unidirectionally through a path encompassing said wheels and through a linear cutting region, means for moving the other wheel towards and away from the driven wheel for tensioning the metallic band, workpiece support means stationed in the cutting region adapted to raise a workpiece to the metallic band at a controlled speed, means for supplying an abrasive slurry to said metallic band in the cutting region upstream of the workpiece, and guide-wipers upstream and downstream of the cutting region each comprising a pair of opposed, laterally and linearly offset wipers for dampening lateral motion of the metallic band, maintaining the band in alignment across the workpiece and wiping the band of abrasive slurry before the band passes over the driven wheel.

9 Claims, 11 Drawing Figures

FIG. 2.
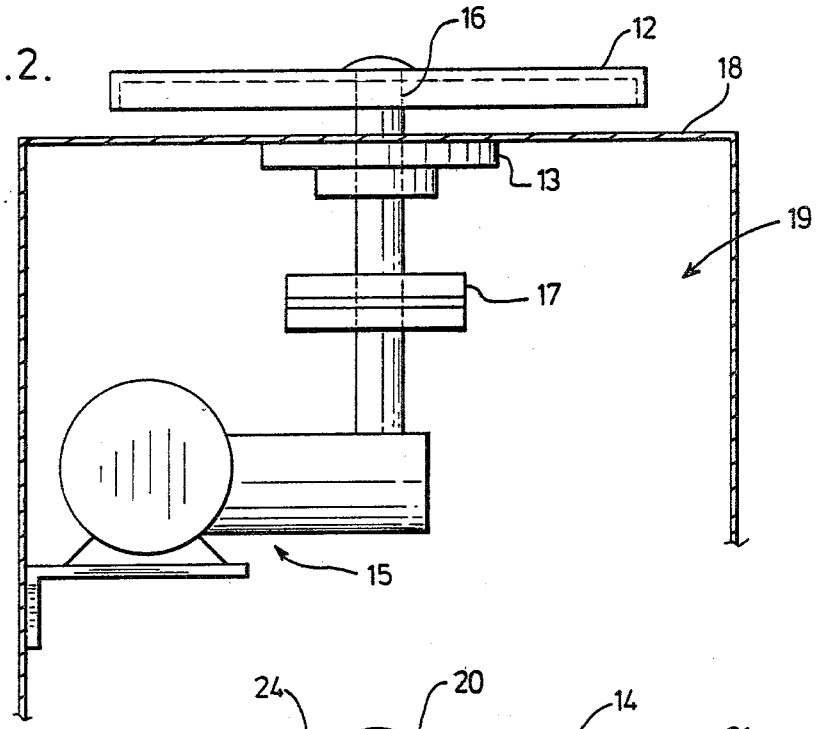
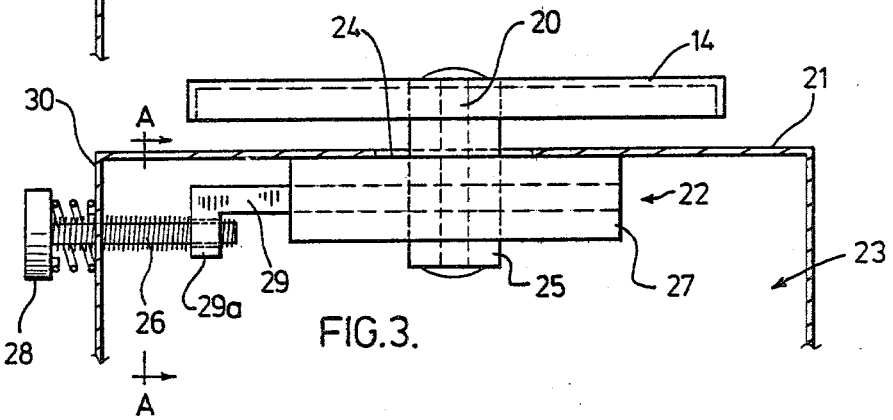
FIG. 3.
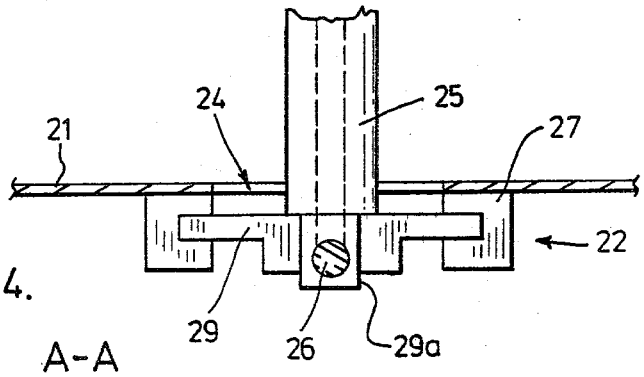
FIG. 4.
A-A

FIG.10.
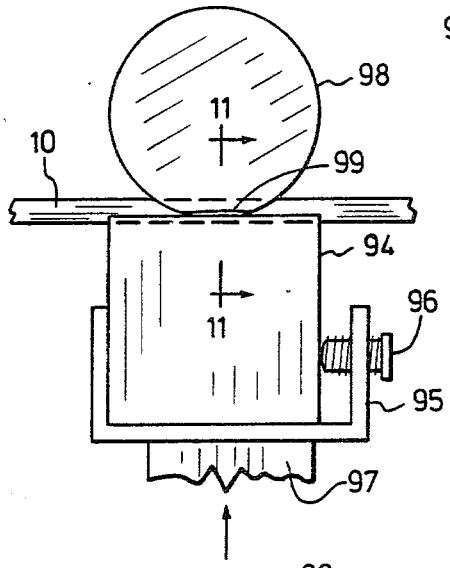
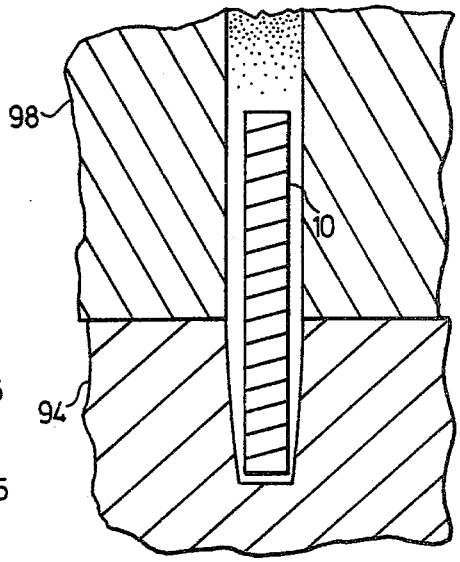
FIG.11.
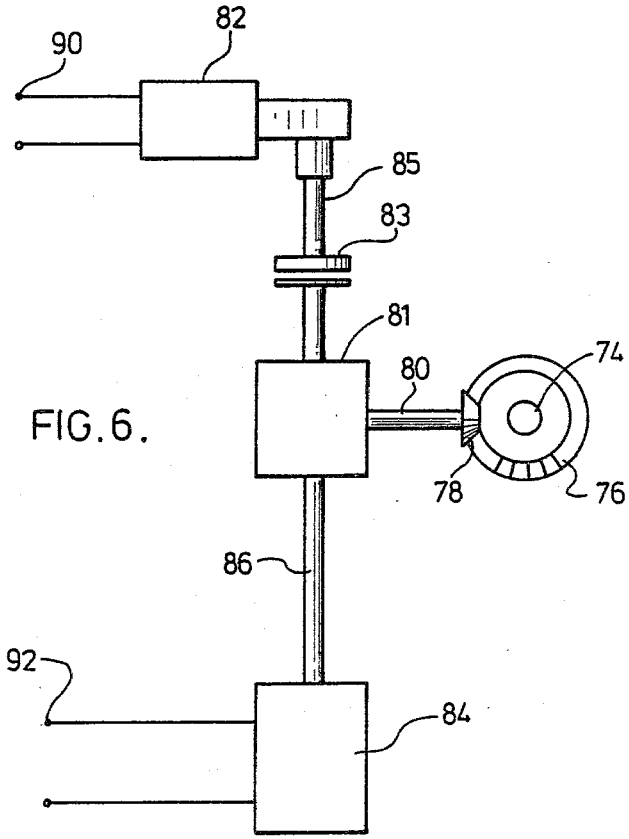
FIG.6.

CUTTING APPARATUS FOR SEMI-CONDUCTOR MATERIALS

BACKGROUND OF THE INVENTION

This invention relates to a cutting apparatus and is particularly directed to a cutting apparatus for slicing semiconductor materials into wafers.

U.S. Pat. No. 3,599,623, which discloses a closed-loop saw having a continuous band with diamond powder cutting edge, comments on disadvantages inherent in several known techniques such as the scribe-and-break process, sawing with closed wire loops with abrasive slurries, and sawing with reciprocating blades with the workpiece stationary or moved into the saw blade, for severing semiconductor wafers into individual devices. Disadvantages commonly encountered include: difficulty in severing semiconductor materials, particularly friable and expensive materials, into small dies; the inability to produce consistently straight and planar cuts; crumbling of the sides of the cuts; the need for complex and expensive systems; and in the method of the above-mentioned patent, the formation of saw marks on cut surfaces.

It is a principal object of the present invention to provide a cutting apparatus for precision slicing of semiconductor materials with a minimum of kerf loss yielding smooth cut surfaces substantially free of saw marks which normally do not require subsequent lapping.

SUMMARY OF THE INVENTION

The cutting apparatus of the invention broadly comprises a pair of spaced-apart co-planar rotatable wheels, a continuous metallic band passing over said wheels, means for driving one of said wheels to move said band unidirectionally through a path encompassing said wheels and through a linear cutting region, means for moving the other wheel towards and away from the driven wheel for tensioning the metallic band, workpiece support means stationed in the cutting region adapted to raise a workpiece to the metallic band at a controlled speed, means for supplying an abrasive slurry to said metallic band in the cutting region upstream of the workpiece, and guide-wipers upstream and downstream of the cutting region each comprising a pair of opposed, laterally and linearly offset wipers for dampening lateral motion of the metallic band, maintaining the band in alignment across the workpiece and wiping the band of abrasive slurry before the band passes over the driven wheel.

BRIEF DESCRIPTION OF THE DRAWINGS

The foregoing and other objects of the invention and the manner in which they can be attained will become apparent from the following description of the drawings, in which:

FIG. 2 is a rear view of the upper right-hand portion of the apparatus illustrated in FIG. 1, showing the drive wheel mechanism;

FIG. 3 is a rear view of the upper left-hand portion of the apparatus illustrated in FIG. 1, showing the band tensioning mechanism;

FIG. 4 is a section taken along line 4—4 of FIG. 3;

FIG. 6 is a schematic illustration of the vertical drive assembly of the present invention;

FIG. 10 is a front elevation of the workpiece holder with an ingot mounted thereon; and FIG. 11 is an enlarged section along the line 11—11 of FIG. 10 illustrating the profile of a saw kerf.

DESCRIPTION OF THE PREFERRED EMBODIMENT

Figure 1:
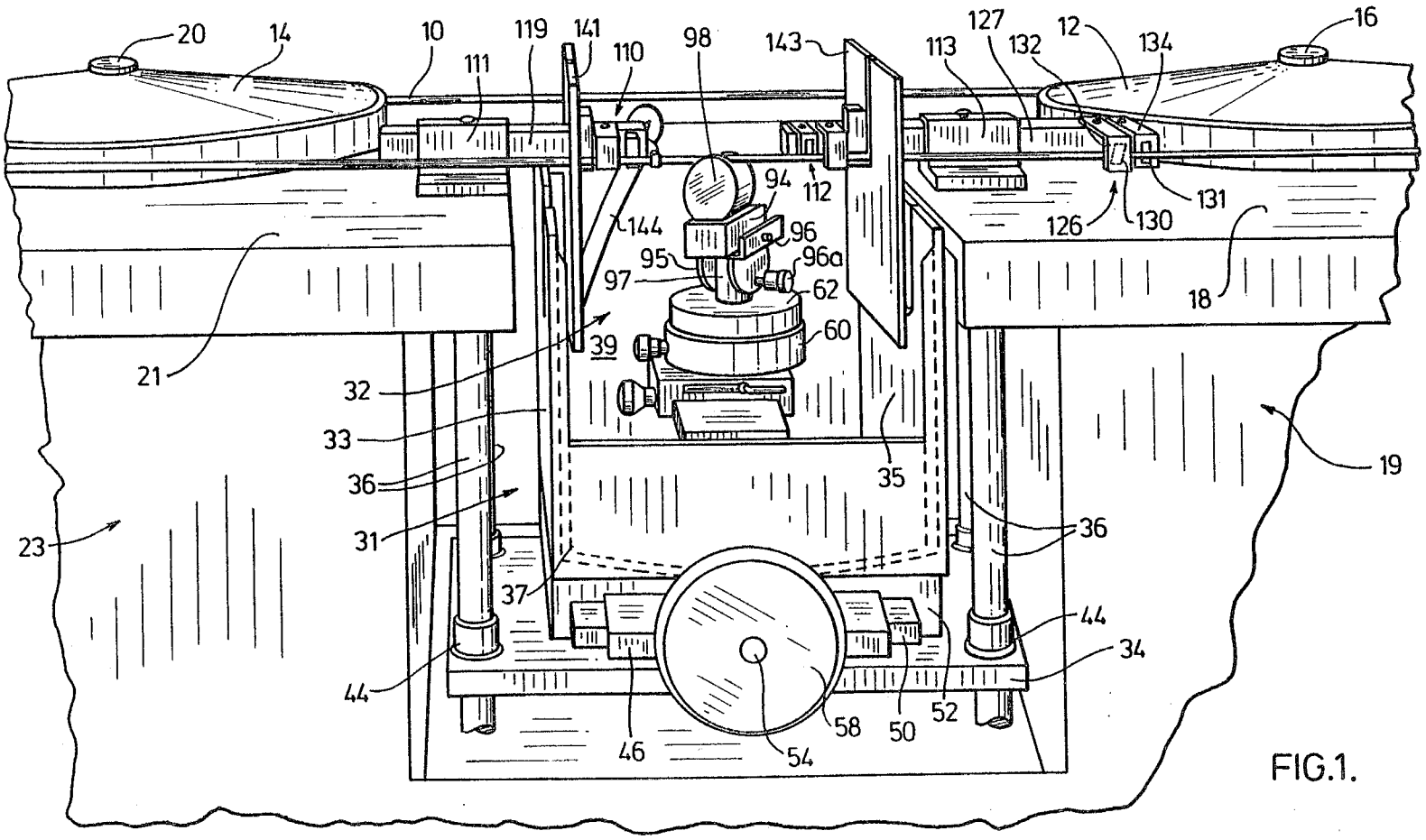
FIG. 1 is a perspective view of the apparatus of the invention.

With reference now to FIGS. 1–4 of the drawings, the cutting apparatus comprises a closed loop metallic band 10 formed of carbon steel having a preferred thickness of 0.13 mm and width of 6.4 mm with a substantially rectangular cross-section. Band 10 passes around a portion of the periphery of each of spaced-apart co-planar crowned wheels 12 and 14. Wheel 12 is a driven wheel fixedly secured on shaft 16 journalled for rotation through bushing 13 attached to top plate 18 of cabinet 19. Wheel 12 on shaft 16 is driven by a variable speed motor 15 operatively connected to shaft 16 in series with a flexible coupling 17. Wheel 14 is a tension wheel rotatably mounted on shaft 20 and bushing 25 journalled in slide assembly 22 mounted below opening 24 in top plate 21 of cabinet 23 and tensioned by means of threaded rod 26, having exposed spring-loaded adjustment knob 28, which passes through stationary end plate 30. Slide assembly 22 consists of slide guide 27 attached to plate 21 and slide 29 with flange protrusion **29*a* through which threaded bolt 26 is threaded. Turning adjustment knob 28 on bolt 26 draws shaft 20 and wheel 14 mounted thereon towards or away from fixed wheel 12 for adjusting the tension of band 10**.

Figure 7:
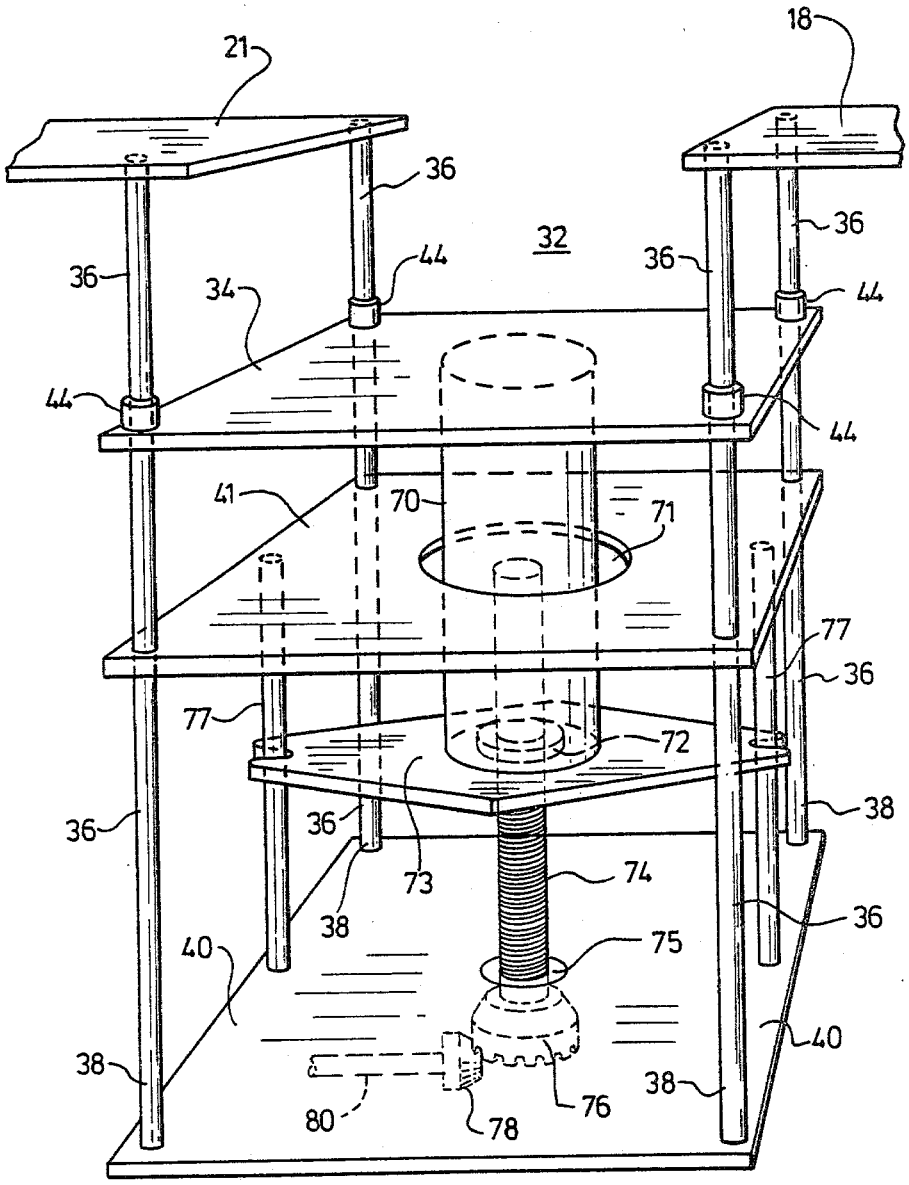
FIG. 7 is a perspective view of the table support elevating mechanism.

Top plates 18 and 21 are spaced apart to define a cutting region 32 within which movable table support 34 is guided for reciprocal vertical travel along four vertically extending rods 36 positioned in each corner thereof, as shown most clearly in FIGS. 1 and 7. Each of rods 36 is rigidly mounted at its lower end 38 in base 40, passes freely through fixed guide plate 41 attached between cabinets 19 and 23 and is rigidly mounted at its upper end in the underside of top plate 18 or 21. Bushings 44 seated on movable table support 34 slidably receive guide rods 36 for vertical travel of the said movable table support.

Figure 5:
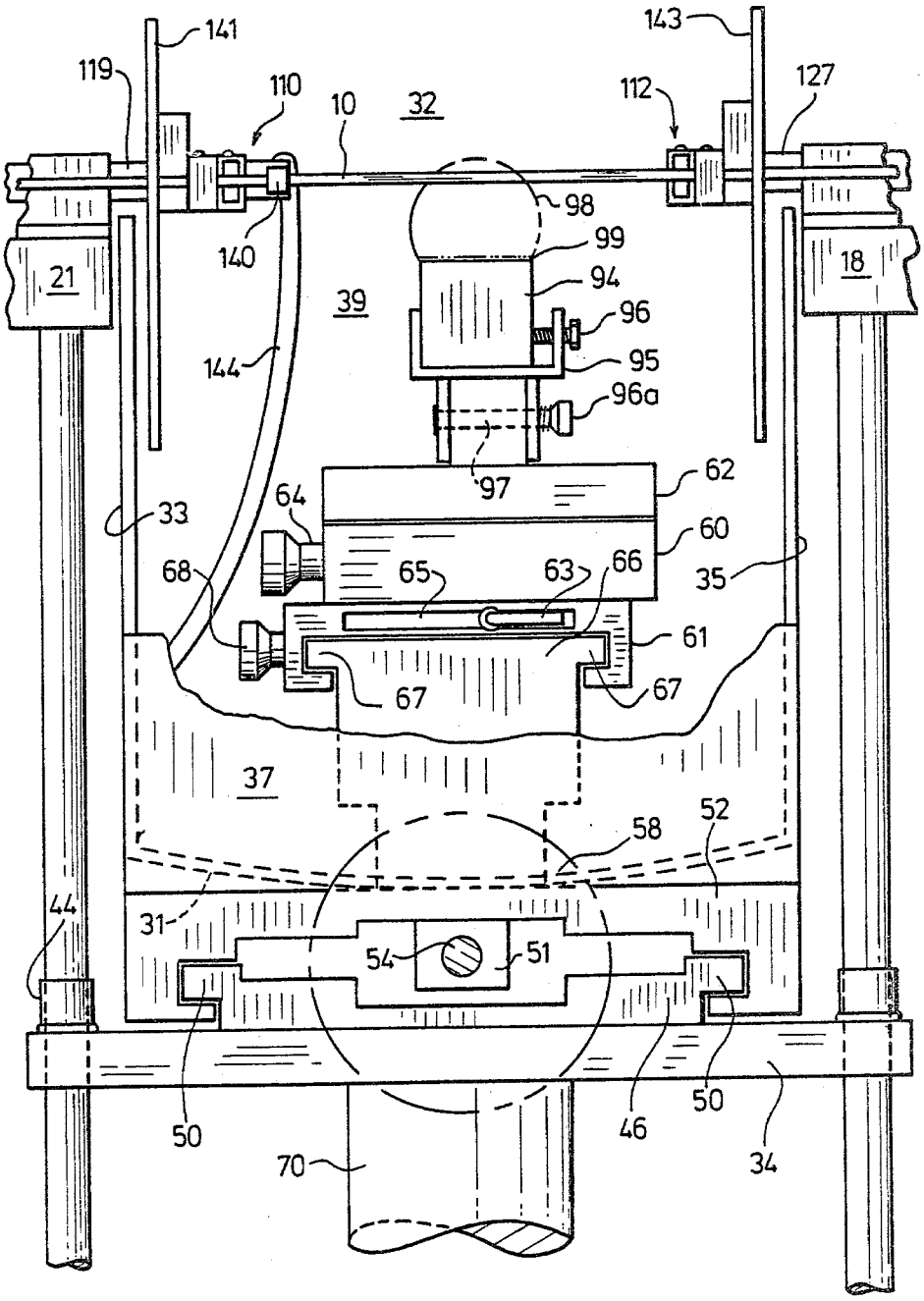
FIG. 5 is a front elevation of the said apparatus, partly cut away.

Table support 34, shown in more detail in FIG. 5, has horizontally disposed slide guide 46 bolted thereon with lateral longitudinally extending guides 50 for receiving indexing slide 52 mounted thereon for forward and rearward reciprocal travel. An indexing screw 54 is threaded into a stationary nut 51 attached to indexing slide 52 at the rearward extremity of the cutting region and has indexing wheel 58 at its forward end for permitting controlled movement of indexing slide 52 on slide guide 46. Indexing wheel 58 may comprise a micrometer assembly, well known in the art, for manual indexing of the cutting operations. Alternatively, indexing screw 54 may be operatively connected to a stepping motor, not shown, which is energized via suitable solid-state electric circuitry to allow automatic indexing. A catch basin 31 mounted on slide 52 to enclose the lower portion of cutting region 32 has side walls 33,35 and front and rear walls 37,39.

Circular turntable 62 is rotatably mounted on table 60 concentric therewith and may be rotated on table 60 about a vertical axis and locked in a desired angular position by means of screw clamp 64. Table 60 is slidably mounted on base 61 for lateral movement and is locked in a desired position by clamp 63 extending through base slot 65. Base 61 is mounted on a slide guide 66 having lateral longitudinally extending guides 67 for forward and rearward adjustment and can be locked in a desired position by screw clamp 68. Slide guide 66 is mounted on indexing slide 52.

FIG. 7 is a perspective view of the table elevating mechanism. Movable table support 34 is raised towards and lowered away from metallic band 10 by support column 70 which passes upwardly from a movable guide plate 73 through opening 71 formed centrally in fixed guide plate 41. Movable guide plate 73 straddles guide rods 77 extending between base 40 and stationary guide plate 41. A drive-nut 72 is attached centrally underneath movable guide plate 73 and coaxially with support column 70. A lead screw 74 extends through drive-nut 72 upwardly into support column 70 and downwardly through hole 75 in base 40 and terminates on a lower crown gear 76 engageable by pinion gear 78 driven by shaft 80 extending from T-drive 81, shown in FIG. 6. A variable, low speed, table updrive motor 82 is operatively connected to one side of T-drive 81 by electric clutch 83 in series in shaft 85 for elevation of the table support 34 at a desired slow speed. Return motor 84 operatively connected to the opposite side of T-drive 81 by shaft 86 overrides updrive motor 82 for return of table support 34 to its downwardly retracted position at a relatively high speed.

Motors 82 and 84 are electrically connected to normally open limit switch assemblies 90,92, respectively, whereby switch 92 is opened and switch 90 is closed at the lower extremity of travel of table support 34 to de-energize return motor 84 and to concurrently energize updrive motor 82 and electric clutch 83 raising the table support 34 at a desired slow rate to its upper extremity of travel, at which time switch 90 is opened and switch 92 closed to de-energize motor 82 and clutch 83 and to energize motor 84 for a quick return of table support 34 to its lowermost position for initiation of the next cutting cycle.

The upper surface of turntable 62, FIGS. 1, 5 and 10, has workpiece holder 94 made of carbon or suitable ceramic material removably secured by screw 96 of tilting clamp 95 for supporting workpiece 98 bonded thereto such as by a layer of wax or an adhesive cement 99. Clamp 95 is pivotally mounted on vertical spindle 97 which extends upwardly from turntable 62 about screw **96*a* which can be tightened to lock clamp 95** at a desired angle relative to the horizontal.

Figure 8:
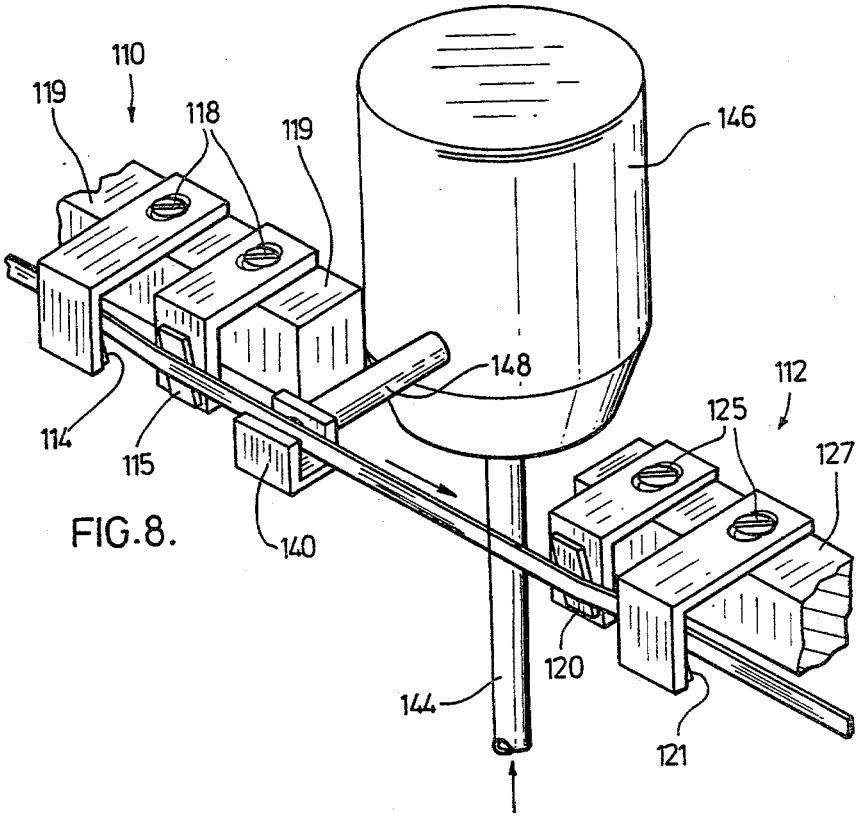
FIG. 8 is a perspective view of an embodiment of slurry feed and guide-wiper assembly for alignment of the saw band in the cutting region.
Figure 9:
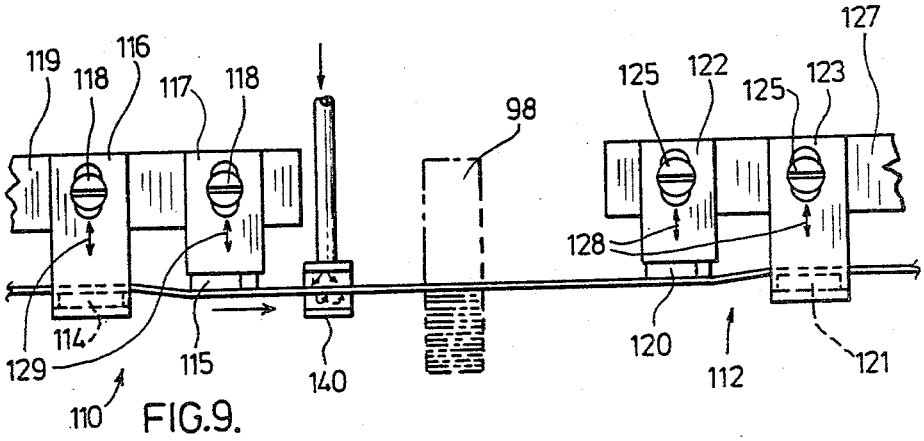
FIG. 9 is a plan view of the said guide-wiper assembly.

With reference to FIGS. 1, 5, 8 and 9, guide-wiper 110 is located upstream of the cutting region 32 and a guide-wiper 112 is located downstream of the said region 32 for precise alignment of metallic band 10 through the said cutting region. With particular reference to FIGS. 8 and 9, guide-wiper 110 comprises a pair of opposed, laterally and linearly offset rubber wipers 114,115 cemented onto mounting brackets 116,117, respectively, which are secured by means of screws 118 onto support bar 119 for horizontal transverse adjustment as indicated by the arrows depicted by numeral 129 in FIG. 9. Support bar 119 is mounted on top plate 21 for longitudinal adjustment by tie-down clamp 111 (FIG. 1). Sequential rubber wipers 114,115 preferably are linearly offset from each other such that the metallic band 10 is pinched therebetween for compressing the rubber wipers and slightly deflecting the metallic band whereby it is precisely aligned as it departs from rubber wiper 115 across the cutting region. Downstream guide-wiper 112 comprises a similar arrangement of a pair of opposed, laterally and linearly offset wipers 120,121 cemented onto brackets 122,123, respectively, and brackets 122,123 are adjustably secured to support bar 127 by means of screws 125 for horizontal transverse adjustment as indicated by the arrows depicted by numeral 128 in FIG. 9. Support bar 127 is mounted on top plate 18 by tie-down clamp 113 (FIG. 1). Each of rubber wipers 114,115 and 120,121 preferably is secured to its respective bracket at a 10°–20° rake angle from the vertical, as shown in FIG. 8. The pinching of the rubber wipers and the resulting slight deflection of the band, together with the rake angle of the rubber wipers, have been found to avoid chatter and bounce of the band as it passes over the wipers, to provide an improved wiping action.

A third guide-wiper 126, FIG. 1, is provided in proximity to fixed wheel 12 for wiping abrasive slurry from the metallic band prior to passage of the metallic band about the fixed wheel. Guide-wiper 126 comprises a pair of opposed, laterally and linearly offset rubber wipers 130,131 mounted on brackets 132,134 secured to support bar 127.

Vertical splash protectors 141,143 are secured to support bars 119,127 respectively and extend downwardly to overlap the side walls 33,35 of catch basin 31. An abrasive slurry is fed to metallic band 10 immediately downstream of the first guide-wiper 110 by means of feed cup 140. Feed cup 140 can be supplied directly from a slurry reservoir, not shown, through line 144, FIGS. 1 and 5, by a variable speed slurry pump, not shown, or from a surge vessel 146 and line 148 positioned in line 144, FIG. 8. The slurry reservoir is, preferably, equipped with means for air agitation. The slurry is formed from a paste consisting of, for example, 500 g of 400 grit SiC powder, 400 g of glycerine and approximately 250 g (ml) of water. Water is carefully added to establish and maintain a specific gravity of 1.50 to 1.55. This range is maintained by water additions during operation to replace water evaporated in air and by the air agitation of the slurry reservoir.

In operation, an ingot 98 of semi-conductor material, mounted with wax or an adhesive cement on the workpiece holder 94 of the work-holding assembly, is positioned by clamping the holder on spindle 97 at the desired angle and rotating the turntable 62 to align the ingot in a desired orientation. The indexing wheel 58 is rotated manually by means of the micrometer assembly, or automatically by means of a stepping motor, to adjust the indexing assembly rearwardly or forwardly for obtaining the desired thickness of the slice to be cut. The positions of the upper and lower limit switches 90,92 connected to the updrive motor 82 and the return motor 84, respectively, are adjusted to provide the required length of vertical reciprocal travel of the table support 34.

The driven wheel 12 is rotated by the variable-speed drive motor at the desired peripheral speed of, for example, about 250 m/min, the band 10 tension is adjusted as desired and the abrasive slurry fed continuously by way of feed cup 140 onto the band at the upstream end of the cutting region 32.

The slurry pump and air-agitation of the slurry reservoir are started and the slurry is continuously circulated during operation, slurry being passed from the reservoir by the variable-speed slurry pump directly to feed cup 140 or to the slurry surge-vessel 146 and then to the slurry feed cup 140 from which it is transported by the tape to the ingot. Slurry wiped from the tape by guide-wiper 112 is collected in the catch basin 31 (FIG. 1) and returns by gravity to the reservoir. A second slurry catch basin (not shown) is situated in plate 18 below the last guide-wiper 126 to permit collected slurry to flow back into the reservoir.

The velocity rate of the upward travel of table 60 is set at the required value and either automatic or manual indexing is used, as desired. The movable table support 34 now commences its upward travel and cutting of the ingot starts as soon as the saw band is in proximity to the ingot. Cutting is effected only by the cutting fluid as the band is smooth and no upward pressure is exerted by the ingot against the band. The upward travel and cutting continues until a slice is cut off, the band 10 has penetrated the holding block as depicted in FIG. 11 and the limit switch 90 on the updrive motor is tripped. The electrical clutch 83 then disengages and the high speed table return motor 84 is activated for returning the movable table support 34 to its original position. Lowering of the table support 34 continues until the limit switch 92 on the return motor is tripped and the return motor de-activated. The indexing assembly is now activated, either manually or automatically, by turning the indexing wheel 58 and the ingot is moved horizontally the required distance necessary for obtaining the next slice. The electrical clutch 83 then re-engages and the updrive starts to repeat the cutting cycle. Upon completion, the saw is switched off and the slices are removed. The slices may be lapped on both sides to remove any slight outward taper formed at the bottom of the kerf.

The cutting apparatus of the invention is useful for the cutting of any brittle material, particularly for cutting slices or wafers of semi-conductor materials with a crystal lattice that can be easily damaged, such as, for example, cadmium mercury telluride or indium antimonide. Cutting is performed with a minimum of kerf-loss. For example, an ingot of cadmium mercury telluride, 40 mm long and 15 mm diameter, was cut in 40 slices, each slice being 0.8 mm thick. The kerf loss per slice was 0.2 mm and the time for cutting each slice was 15 minutes.

It will be understood, of course, that modifications can be made in the embodiment of the invention illustrated and described herein without departing from the scope and purview of the invention as defined by the appended claims.

What we claim as new and desire to protect by Letters Patent of the United States is:

1. A cutting apparatus comprising a pair of spaced-apart co-planar rotatable wheels, a continuous metallic band passing over said wheels, means for driving one of said wheels to move said band unidirectionally through a path encompassing said wheels and through a linear cutting region, means for moving the other wheel towards and away from the driven wheel for tensioning the metallic band, workpiece support means stationed in the cutting region adapted to raise a workpiece to the metallic band at a controlled speed, means for supplying an abrasive slurry to said metallic band in the cutting region upstream of the workpiece, and guide-wipers upstream and downstream of the cutting region each comprising a pair of opposed, laterally and linearly offset wipers for dampening lateral motion of the metallic band, maintaining the band in alignment across the workpiece and wiping the band of abrasive slurry before the band passes over the driven wheel.

2. A cutting apparatus as claimed in claim 1, in which said pair of spaced-apart wheels is rotatable in a common horizontal plane and said workpiece support means comprise a table, a turntable rotatably mounted on the table about a vertical axis and workpiece clamping means pivotally mounted on the turntable about a horizontal axis for orienting the workpiece relative to the metallic band, means for moving the table horizontally transversely relative to the metallic band in the linear cutting region, and means for raising the table and workpiece supported thereon vertically upwardly to the metallic band at a controlled speed less than the cutting rate of the metallic band and abrasive slurry whereby the metallic band does not contact the workpiece.

3. A cutting apparatus as claimed in claim 2, in which said guide-wipers positioned next upstream and downstream of the cutting region each comprises a pair of opposed laterally offset rubber wipers linearly offset from each other for receiving and slightly deflecting the metallic band therebetween.

4. A cutting apparatus as claimed in claim 2, in which the guide-wipers positioned next upstream and downstream of the cutting region each comprises a pair of opposed, laterally offset rubber wipers mounted at an angle of about 10° to 20° from the vertical on support members linearly offset from each other, and means for laterally adjusting the support members whereby the metallic band is pinched between the rubber wipers for compressing the rubber wipers and slightly deflecting said metallic band and aligning the metallic band within the cutting region.

5. A cutting apparatus as claimed in claim 4, in which said abrasive slurry is supplied to the metallic band between the upstream guide-wiper and the cutting region and a guide-wiper is interposed between the downstream guide-wiper and driven wheel.

6. A cutting apparatus as claimed in claim 2, in which said means for raising the table and workpiece supported thereon vertically upwardly comprises a vertically reciprocal table support on which the table and means for moving the table horizontally are mounted, a support column secured to the table support, a vertically aligned lead screw operatively connected to the support column whereby rotation of said screw raises and lowers the support column and support table secured thereto, and motor drive means for rotating said lead screw in one direction at a controlled speed whereby the table and workpiece supported thereon are raised vertically upwardly to the metallic band at a speed less than the cutting rate of the metallic band and abrasive slurry and for rotating said lead screw in the opposite direction at a relatively high speed for lowering the table and workpiece supported thereon at a high speed.

7. A cutting apparatus as claimed in claim 6, in which said motor drive means comprises a variable, low speed electric motor operatively connected to the lead screw by an electric clutch and T-drive in series for raising the table at a desired slow speed, a high speed electric motor operatively connected to the T-drive for lowering the table at a high speed, and limit switching means electrically connected to said electric motors actuated at the lower extremity of vertical travel of the table for energizing the low speed electric motor and electric clutch for raising the table and actuated at the upper extremity of vertical travel of the table for energizing the high speed electric motor and concurrently de-energizing the low speed electric motor and electric clutch for quick lowering of the table.

8. A cutting apparatus as claimed in claim 7, in which said means for moving the table horizontally transversely relative to the metallic band in the linear cutting region comprises a slide guide rigidly secured to the table support, an indexing slide slidably mounted thereon for forward and rearward travel, an indexing screw operatively connected to the slide for controlled movement of the slide on the slide guide, and means for mounting the table on the slide.

9. A cutting apparatus as claimed in claim 8, in which said means for mounting the table on the slide comprises a second slide guide extending upwardly from the said slide, a second slide slidably mounted on the second slide guide for forward and rearward travel, means for locking said second slide on the second slide guide, means for slidably mounting the table on the second slide for lateral movement relative to the travel of the second slide, and means for locking the table on the second slide.

* * * * *